US010345748B2

(12) United States Patent
Nagai

(10) Patent No.: US 10,345,748 B2
(45) Date of Patent: Jul. 9, 2019

(54) SLIDING MEMBER, SLIDING MEMBER FOR FIXING DEVICE, FIXING DEVICE, AND IMAGE FORMATION APPARATUS

(71) Applicant: Konica Minolta, Inc., Tokyo (JP)

(72) Inventor: Yasuki Nagai, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/837,805

(22) Filed: Dec. 11, 2017

(65) Prior Publication Data

US 2018/0173141 A1 Jun. 21, 2018

(30) Foreign Application Priority Data

Dec. 15, 2016 (JP) ..... 2016-243645
May 11, 2017 (JP) ..... 2017-094635

(51) Int. Cl.
*G03G 15/00* (2006.01)
*G03G 15/20* (2006.01)

(52) U.S. Cl.
CPC ..... *G03G 15/2053* (2013.01); *G03G 15/2025* (2013.01); *G03G 15/206* (2013.01)

(58) Field of Classification Search
CPC ..... G03G 15/2053; G03G 2215/2032; G03G 2215/2016
See application file for complete search history.

(56) References Cited

U.S. PATENT DOCUMENTS 5,415,791 A * 5/1995 Chou ..... C10M 169/04 508/103
2013/0034720 A1* 2/2013 Maniwa ..... G03G 15/2025 428/316.6
2014/0241766 A1* 8/2014 Ishii ..... G03G 15/2025 399/329

FOREIGN PATENT DOCUMENTS

JP H08262903 A 10/1996
JP H10213984 A 8/1998
JP 2001249558 A 9/2001
JP 2004029607 A 1/2004
JP 2004206105 A 7/2004

* cited by examiner

*Primary Examiner* — Walter L Lindsay, Jr.
*Assistant Examiner* — Jessica L Eley
(74) *Attorney, Agent, or Firm* — Lucas & Mercanti, LLP

(57) ABSTRACT

A sliding member includes a first fiber sheet composed of ultrafine fibers composed of a first polymer of a polysulfide-based polymer, a polyimide-based polymer, a polyamide-based polymer or a polyamideimide-based polymer, the ultrafine fiber, when composed of the polyimide-based polymer or the polyamideimide-based polymer, having an average fiber diameter of 0.5 μm or more and 5 μm or less, the ultrafine fiber, when composed of the polysulfide-based polymer or the polyamide-based polymer, having an average fiber diameter of 1 μm or more and 15 μm or less.

16 Claims, 5 Drawing Sheets

SLIDING MEMBER, SLIDING MEMBER FOR FIXING DEVICE, FIXING DEVICE, AND IMAGE FORMATION APPARATUS

Japanese Patent Application Nos. 2016-243645 and 2017-094635 filed on Dec. 15, 2016 and May 11, 2017, respectively, including description, claims, drawings, and abstract the entire disclosure is incorporated herein by reference in its entirety.

BACKGROUND

Technological Field

The present invention relates to a sliding member, a sliding member for a fixing device, a fixing device, and an image formation apparatus.

Description of the Related Art

Japanese Laid-Open Patent Publication No. 08-262903 discloses a fixing device with which an image formation apparatus of an electrophotography system, such as a printer, a copier, and a facsimile is equipped. This fixing device has a pressurizing and fixing roll, an endless belt in contact with this pressurizing and fixing roll, and a pressing member which is disposed inside this endless belt and presses an inner circumferential surface of the endless belt toward the pressurizing and fixing roll. This type of fixing device allows the roll and the belt to be pressed into contact with each other to form a fixing nip, and accordingly, it is referred to as a belt nip fixing system and is considered to be advantageous in that it is excellently energy-saving, light-weight, compact and inexpensive.

Japanese Laid-Open Patent Publication No. 10-213984 discloses a fixing device of a configuration in which a sheet-shaped sliding member sliding on an inner circumferential surface of a pressurizing belt is provided to a pressing member and a lubricant is interposed between this sheet-shaped sliding member and the inner circumferential surface of the pressurizing belt. This fixing device can have between the inner circumferential surface of the pressurizing belt and the pressing member a sliding resistance reduced by the lubricant and thus allows the pressurizing belt to be smoothly, circularly moved together with the fixing roll. For this sheet-shaped sliding member, a sliding member comprising glassy cloth or the like impregnated with a fluorocarbon resin and sintered (a so-called PTFE (polytetrafluoroethylene) based sliding member) is used. PTFE-based sliding members are also disclosed in Japanese Laid-Open Patent Publication Nos. 2001-249558 and 2004-206105.

SUMMARY

A PTFE-based sliding member has a self-lubricating property under high load and high speed conditions and accordingly, tends to have its projecting portions cleft and thus abraded. As the PTFE-based sliding member is thus abraded, it has the projecting portions eliminated and abrasion powder is also generated, and accordingly, a fixing device including the PTFE-based sliding member tends to have its torque increasing with its driving time and consequently have a reduced lifetime. On the other hand, from a viewpoint of energy conservation and cost reduction in the field of commercial printing, there is a demand for a long-life fixing device with less frequent exchange of parts even under high load and high speed conditions.

The present disclosure has been made in view of the above circumstances, and contemplates a sliding member, a sliding member for a fixing device, a fixing device, and an image formation apparatus, that have a long lifetime to be able to serve for long-term use. To achieve at least one of the abovementioned objects, according to an aspect of the present invention, a sliding member reflecting one aspect of the present invention comprises a first fiber sheet composed of ultrafine fibers composed of a first polymer of a polysulfide-based polymer, a polyimide-based polymer, a polyamide-based polymer or a polyamideimide-based polymer, the ultrafine fiber, when composed of the polyimide-based polymer or the polyamideimide-based polymer, having an average fiber diameter of 0.5 μm or more and 5 μm or less, the ultrafine fiber, when composed of the polysulfide-based polymer or the polyamide-based polymer, having an average fiber diameter of 1 μm or more and 15 μm or less.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
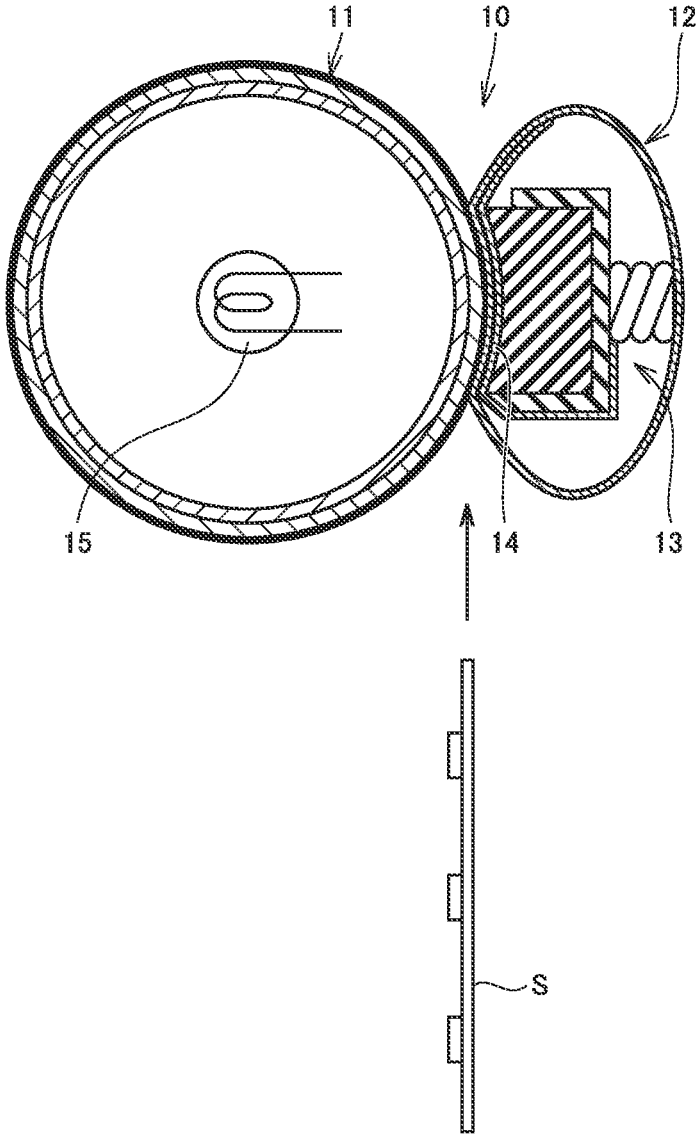
FIG. 1 is a schematic diagram showing a schematic configuration of a fixing device of the present embodiment.

Hereinafter, one or more embodiments of the present invention will be described with reference to the drawings. However, the scope of the invention is not limited to the disclosed embodiments.

Note that when describing the following embodiment using the drawings, identical reference characters indicate identical or corresponding components.

In the present specification, the expressions "A to B," "A-B" and the like mean a range's upper and lower limits (that is, being equal to or greater than A and equal to or less than B), and when there is no unit indicated for A, and B is alone accompanied by a unit, A is also intended to be accompanied by the same unit as B. Note that, in the present specification, "sliding" of a sliding member refers to a nature relating to less friction or slidability relative to a member affected, and an effect thereof is represented by "slidability," which serves as an index of how easily an endless belt with which the sliding member in a fixing device is in contact rotates for example. "Slidability" can be evaluated for example by measuring an external motor's torque, as will be described hereinafter. In this evaluation, "high slidability" or "excellent slidability" indicates that low torque is measured and "low slidability" or "poor slidability" indicates that high torque is measured.

The present inventor has found out that a fiber sheet composed of ultrafine fibers formed of a prescribed material and having an average fiber diameter for example of 0.5 μm or more and 5 μm or less, characteristically has a low shear stress, a high porosity and a small direct contact area (or true contact area (As)), and has accordingly conceived that it can be a material which can exhibit excellent performance such as a minimum friction coefficient (μ) as a sliding member (hereinafter also referred to as "excellent slidability). The present inventor has considered that the friction coefficient can be further reduced by blending the fiber sheet with a fluorine compound. The fiber sheet, having a high porosity, can be impregnated with a lubricant in an increased amount, and it is expected that the fiber sheet used in combination with the lubricant also easily presents satisfactory lubricity. The present inventor has focused on these points and diligently studied, and finally reached the present disclosure.

Furthermore, the present inventor has found that depending on the material of the ultrafine fiber, a fiber sheet composed of ultrafine fibers having an average fiber diameter for example of 1 μm or more and 15 μm or less, can be a material which can exhibit excellent slidability. While it has been inferred that from the viewpoint of porosity and As, smaller average fiber diameters allow more excellent slidability, it has been confirmed that such is not exclusive, depending on the ultrafine fiber's material(s) and its production method. Although the detailed mechanism is unknown, it is believed that inter-fiber binding force, the fiber's shape and force of bonding to a lubricant are involved.

According to an embodiment of the present disclosure, a sliding member comprises a first fiber sheet composed of ultrafine fibers composed of a first polymer of a polysulfide-based polymer, a polyimide-based polymer, a polyamide-based polymer or a polyamideimide-based polymer, the ultrafine fiber, when composed of the polyimide-based polymer or the polyamideimide-based polymer, having an average fiber diameter of 0.5 μm or more and 5 μm or less, the ultrafine fiber, when composed of the polysulfide-based polymer or the polyamide-based polymer, having an average fiber diameter of 1 μm or more and 15 μm or less.

Preferably, the first polymer comprises one or more types of functional groups selected from the group consisting of a sulfide group, an amino group, a carbonyl group, a fluoro group and a fluoroalkyl group.

Preferably, the sliding member has a multilayer structure of two or more layers formed of one or more first fiber sheets and one or more base material sheets, and the base material sheet is identical to or different from the first fiber sheet in material.

Preferably, the base material sheet is a non-porous sheet. Preferably, the base material sheet is also a second fiber sheet.

Preferably, the base material sheet is composed of a second polymer of one or more types selected from the group consisting of a polysulfide-based polymer, a polyimide-based polymer, a polyamide-based polymer and a polyamideimide-based polymer, and the second polymer comprises one or more types of functional groups selected from the group consisting of a sulfide group, an amino group, a carbonyl group, a fluoro group and a fluoroalkyl group.

Preferably, the sliding member is such that at a topmost layer thereof the first fiber sheet is disposed and a surface of the topmost layer serves as a sliding surface.

Preferably, the first fiber sheet is impregnated with a lubricant.

Preferably, the lubricant is in a form of a gel.

Preferably, the lubricant includes siloxane having a reactive substituent, and the siloxane is fixed to the first fiber sheet by the reactive substituent.

Preferably, the reactive substituent is one or more types selected from the group consisting of an amino group, an epoxy group, a glycidyl group, a carboxyl group, an acryloyl group and a methacryloyl group.

Furthermore, according to the present disclosure, a sliding member for a fixing device is the above sliding member used for the fixing device, the fixing device including a roller and an endless belt rotating together in contact with each other, and a pressing member disposed on a side of an inner circumferential surface of the endless belt, the pressing member pressing the inner circumferential surface of the endless belt toward the roller and cooperating with the roller to sandwich the endless belt, the sliding member being disposed between the endless belt and the pressing member.

According to the present disclosure, a fixing device comprises: a roller and an endless belt rotating together in contact with each other; a pressing member disposed on a side of an inner circumferential surface of the endless belt; and the sliding member disposed between the endless belt and the pressing member, the pressing member pressing the inner circumferential surface of the endless belt toward the roller and cooperating with the roller to sandwich the endless belt, the endless belt having the inner circumferential surface composed of one or more types of resin selected from the group consisting of a polyimide-based polymer, a polyamideimide-based polymer, and polyetheretherketone-based polymer.

Preferably, the resin is the polyimide-based polymer.

Preferably, the fixing device comprises a heater to heat at least one of the roller and the endless belt.

According to the present disclosure, an image formation apparatus includes the above fixing device.

<<Sliding Member>>

According to the present embodiment, a sliding member comprises a first fiber sheet composed of ultrafine fibers composed of a first polymer of a polysulfide-based polymer, a polyimide-based polymer, a polyamide-based polymer or a polyamideimide-based polymer. The ultrafine fiber, when composed of the polyimide-based polymer or the polyamideimide-based polymer, has an average fiber diameter of 0.5 μm or more and 5 μm or less. The ultrafine fiber, when composed of the polysulfide-based polymer or the polyamide-based polymer, has an average fiber diameter of 1 μm or more and 15 μm or less. Furthermore, the first polymer preferably comprises one or more types of functional groups selected from the group consisting of a sulfide group, an amino group, a carbonyl group, a fluoro group and a fluoroalkyl group. This allows the sliding member to have a low shear stress, a high porosity and a small direct contact area (or true contact area (As)) and thus exhibit excellent performance such as a minimum friction coefficient (μ) as a sliding member.

<First Fiber Sheet>

The first fiber sheet is composed of ultrafine fibers composed of a first polymer of a polysulfide-based polymer, a polyimide-based polymer, a polyamide-based polymer or a polyamideimide-based polymer. The ultrafine fiber, when composed of the polyimide-based polymer or the polyamideimide-based polymer, has an average fiber diameter of 0.5 μm or more and 5 μm or less. The ultrafine fiber, when composed of the polysulfide-based polymer or the polyamide-based polymer, has an average fiber diameter of 1 μm or more and 15 μm or less.

In the present specification, a "polysulfide-based polymer" refers to a polymer with a polysulfide serving as a principal chain. In the present embodiment, the polysulfide-based polymer is preferably a polymer with a polysulfide serving as a principal chain and having a constituent functional group, or an alkyl group, of the aromatic class. A "polyimide-based polymer" refers to a polymer with polyimide serving as a principal chain. In the present embodiment, the polyimide-based polymer is preferably a polymer with polyimide serving as a principal chain and having a constituent element of hydrogen partially substituted with one or more types of functional groups selected from the group consisting of an amino group, a carbonyl group, a fluoro group and a fluoroalkyl group. Furthermore, a "polyamide-based polymer" refers to a polymer with polyamide serving as a principal chain. In the present embodiment, the polyamide-based polymer is preferably a polymer with polyamide serving as a principal chain and having a constituent element of hydrogen partially substituted with one or more types of functional groups selected from the group consisting of an amino group, a carbonyl group, a fluoro group and a fluoroalkyl group. A "polyamideimide-based polymer" refers to a polymer with polyamideimide serving as a principal chain. In the present embodiment, the polyamideimide-based polymer is preferably a polymer with polyamideimide serving as a principal chain and having a constituent element of hydrogen partially substituted with one or more types of functional groups selected from the group consisting of an amino group, a carbonyl group, a fluoro group and a fluoroalkyl group.

In the present specification, a "fluoroalkyl group" refers to an alkyl group having 1 to 3 carbon atoms and having a constituent element of hydrogen partially substituted with fluorine by one or two or more. The fluoroalkyl group can include a trifluoromethyl group represented by $CF_3$—, a pentafluoroethyl group represented by $C_2F_5$—, and the like for example. In the present specification, a "carbonyl group" includes not only a so-called carbonyl group but also the portion of C═O included in a carboxylic acid located at a terminal of a polymer and the portion of C═O included in a carboxylic anhydride located at a terminal of a polymer as well.

The ultrafine fiber that, when composed of the polyimide-based polymer or the polyamideimide-based polymer, has an average fiber diameter of 0.5 μm or more and 5 μm or less, and, when composed of the polysulfide-based polymer or the polyamide-based polymer, has an average fiber diameter of 1 μm or more and 15 μm or less, can ensure fiber strength (tensile strength) and in addition enhance the first fiber sheet's porosity and reduce the first fiber sheet's true contact area (As). An ultrafine fiber having an average fiber diameter less than 0.5 μm results in low fiber strength (or tensile strength) and tends to be broken in use, and the sheet may be torn. An ultrafine fiber having an average fiber diameter exceeding 15 μm results in low porosity and tends to provide an increased true contact area (As), and may result in impaired slidability. This also tends to reduce an amount of a lubricant that the first fiber sheet can be impregnated with. The ultrafine fiber composed of the polyimide-based polymer or the polyamideimide-based polymer preferably has an average fiber diameter of 1 to 4 μm. The ultrafine fiber composed of the polysulfide-based polymer or the polyamide-based polymer preferably has an average fiber diameter of 5 to 10 μm.

The first fiber sheet, in view of strength and sufficient porosity, and for a reduced true contact area (As), preferably has a thickness of 10 to 200 μm, more preferably 20 to 100 μm.

While the first fiber sheet should not be limited in how it is produced, preferably it is nonwoven fabric produced by electrospray deposition (ESD), melt spinning, or the like for example. The ESD method refers to a method in which high voltage is applied to a polymer solution or a molten polymer to spin fibers therefrom and collect them together to produce nonwoven fabric. The ESD method allows ultrafine fibers of 0.5 μm or more and 15 μm or less to be spun at room temperature, and also allows a microstructure of nonwoven fabric formed by collecting the ultrafine fibers to be controlled. The ESD method allows the first fiber sheet to be produced with a porosity and a true contact are (As) as desired. Furthermore, in recent years, there has also been developed a method and apparatus for the melt spinning method that can spin the ultrafine fibers. The melt spinning method refers to a method in which a polymer is thermally molten and sprayed to spin fibers therefrom and collect them together to produce a nonwoven fabric. The melt spinning method allows ultrafine fibers of 0.5 μm or more and 15 μm or less to be spun without using a solvent, depending on the molten polymer's viscosity, the nozzle's diameter, and the spraying condition(s). Furthermore, in the melt spinning method, a microstructure of the nonwoven fabric formed by collecting the ultrafine fibers can also be controlled. Note, however, that although the first fiber sheet is preferably the aforementioned nonwoven fabric, it is not limited thereto, and it may be a woven material or a knitted material. When the ultrafine fiber composed of the polyimide-based polymer, the polyamide-based polymer or the polyamideimide-based polymer is used, then, to produce the first fiber sheet preferably, any one of the ESD method and the melt spinning method may be used. When the ultrafine fiber composed of the polysulfide-based polymer is used, then, to produce the first fiber sheet preferably, using the melt spinning method is recommended.

A material of the ultrafine fiber, i.e., the first polymer, may be any material insofar as it is the polysulfide-based polymer, the polyimide-based polymer, the polyamide-based polymer, or the polyamideimide-based polymer. However, from the viewpoint of having strength and smoothness, the first polymer preferably comprises one or more types of functional groups selected from the group consisting of a sulfide group, an amino group, a carbonyl group, a fluoro group and a fluoroalkyl group, as has been discussed above. For example, the first polymer is preferably composed of polyphenylene sulfide (PPS), polyimide, fluorinated polyimide, aramid, fluorinated aramid, PTFE-based resin, etc. In particular, fluorinated polyimide is preferable as it is excellently resistant to heat and abrasion and less abrasive.

Preferably, the first polymer is specifically a polymer which is polyphenylene sulfide, polyimide, or fluorinated polyimide and has a chemical constitution formula represented by:

(1)

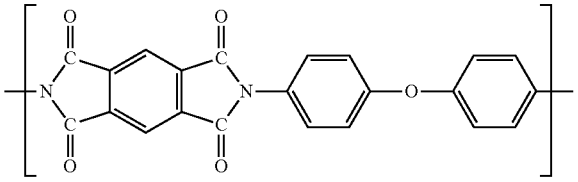

-continued (2)

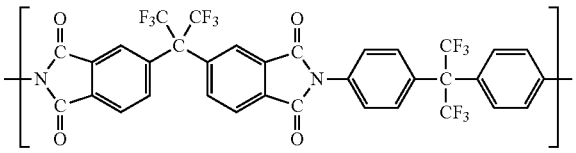

(3)

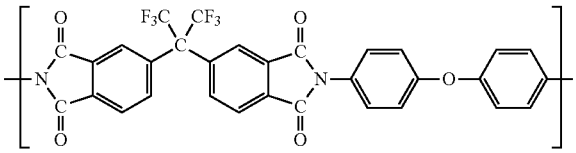

(4)

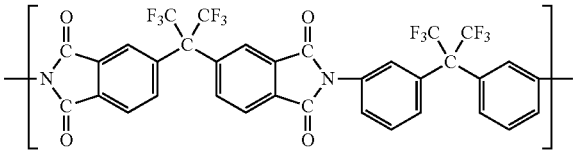

(5)

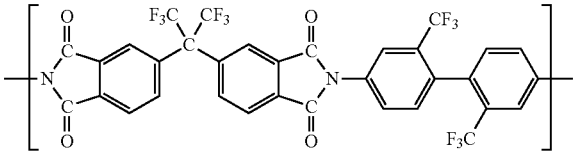

(6)

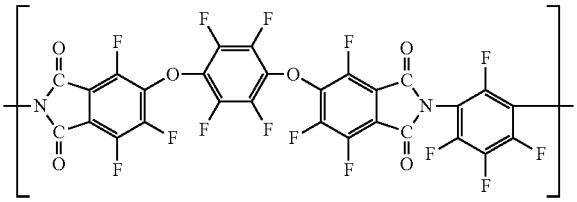

(7)

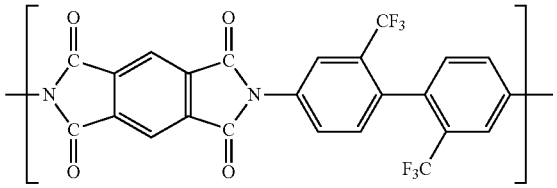

(8)

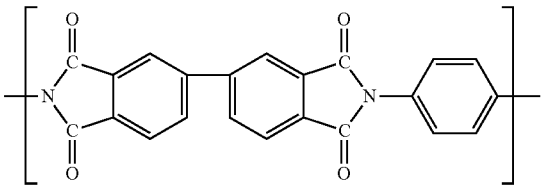

(9)

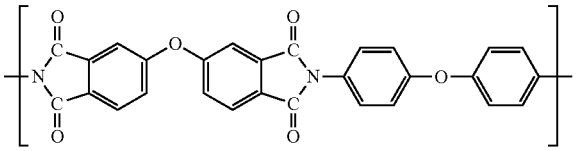

-continued (10)

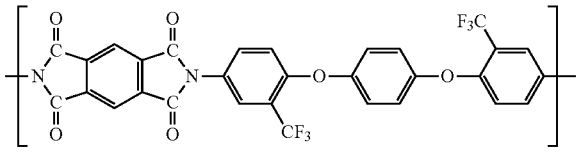

(11)

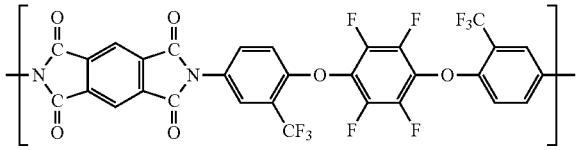

(12)

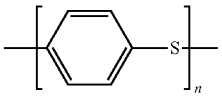

Furthermore, the first polymer is preferably a polymer which is aramid and is poly-m-phenylene isophthalamide, poly-p-phenylene terephthalamide or the like. As poly-m-phenylene isophthalamide, Cornex (registered trademark), Nomex (registered trademark) and the like are known. As poly-p-phenylene terephthalamide, Kevlar (registered trademark), Twaron (registered trademark) and the like are known.

A method of measuring the average fiber diameter of the ultrafine fibers composing the first fiber sheet is as follows: First, the first fiber sheet is observed with a scanning electron microscope (SEM) at a magnification of 5000 times so that five ultrafine fibers each with a measurable diameter appear within one field of view. The five ultrafine fibers in the field of view each have its diameter measured at any two portions thereof. That is, 10 pieces of fiber diameter data are obtained from one field of view and the same observation is performed 10 times in total (i.e., in 10 fields of view) to obtain a total of 100 pieces of fiber diameter data, and an average value of these fiber diameters is defined as an average fiber diameter of the ultrafine fibers. Furthermore, The first fiber sheet is measured in thickness for example as follows: a micrometer (for example, trade name "MDC-25SX," manufactured by Mitutoyo Corporation) is used to measure thickness in micrometers at 10 locations per 10 cm×10 cm and these measured values' average value can be used as the thickness of the first fiber sheet.

Furthermore, including in the first polymer composing the ultrafine fiber one or more types of functional groups selected from the group consisting of an amino group, a fluoro group and a fluoroalkyl group can be confirmed in the following method: That is, it can be confirmed by analyzing a surface of the first fiber sheet with an FT-IR (Fourier Transform Infrared Spectroscopy) device (for example, trade name: "FT/IR-6800," manufactured by JASCO Corporation).

A porosity that the first fiber sheet of the sliding member has refers to a ratio (%) of pores (voids) formed in the first fiber sheet. The porosity (%) is calculated in the following method:

Porosity (%)=(1−first fiber sheet's apparent density ($g/cm^3$)/first fiber sheet's material's true density ($g/cm^3$))×100.

The apparent density is calculated by measuring thickness and mass per 10 cm×10 cm of the first fiber sheet. The true density is that of a source material of the first fiber sheet. In the present specification, when the first fiber sheet has a porosity 50% or more, it is assumed that the first fiber sheet has a high porosity.

A direct contact area (or true contact area: As) that the first fiber sheet of the sliding member has means a true area that can be brought into direct contact with a counterpart member such as a facing smooth endless belt. The As is calculated as follows:

$$As = \text{first fiber sheet's area } (S) \times (1 - \text{porosity}/100).$$

In the present specification, when As/S is 0.5 or less, it is assumed that the first fiber sheet has a small As.

<Layer Structure of Sliding Member>

The sliding member preferably has a multilayer structure of two or more layers formed of one or more first fiber sheets and one or more base material sheets. This base material sheet is preferably identical to or different from the first fiber sheet in material. The sliding member having a multilayer structure of two or more layers can have strength (or tensile strength) increased to endure shearing deformation. When the sliding member is composed of a single layer of the first fiber sheet alone, its high porosity and the ultrafine fiber's extremely small average fiber diameter may be a cause of shearing deformation under high load and high speed conditions. This possibility can be eliminated by forming a sliding member having a multilayer structure of two or more layers formed of one or more first fiber sheets and one or more base material sheets.

<Base Material Sheet>

The base material sheet is preferably a non-porous sheet, and it is also preferable that it be a second fiber sheet. Furthermore, more preferably, the base material sheet is preferably composed of a second polymer of one or more types selected from the group consisting of a polysulfide-based polymer, a polyimide-based polymer, a polyamide-based polymer and a polyamideimide-based polymer, and the second polymer comprises one or more types of functional groups selected from the group consisting of a sulfide group, an amino group, a carbonyl group, a fluoro group and a fluoroalkyl group.

The non-porous sheet means a sheet which is a sheet of film and has an extremely low porosity less than 10. The non-porous sheet is preferably, for example, a polyphenylene sulfide film, a polyimide film, a fluorinated polyimide film, a polyamideimide film or the like. When the non-porous sheet is composed of these films, and combined with the first fiber sheet, it can ensure larger strength (or tensile strength). Among these films, polyphenylene sulfide film and polyimide film are most preferably used as the non-porous sheet as they are excellent in strength and heat resistance and inexpensively available. The porosity of the non-porous sheet can be measured in the same method as used in measuring the porosity of the first fiber sheet.

When a sliding member using the non-porous sheet is applied to a fixing device, the non-porous sheet preferably has a mirror finished surface. The non-porous sheet having a mirror finished surface eliminates the necessity of making the pressing member's surface a mirror finished surface in preventing a pressing member's irregularities from being reflected on the first fiber sheet, and allows the first fiber sheet to exhibit excellent slidability. A pressing member that a fixing device comprises has a surface with irregularities, and when the sliding member is composed of the first fiber sheet alone, the irregularities are reflected on a surface of the first fiber sheet, resulting in an increased true contact area (As), and excellent slidability may no longer be obtained. Here, a non-porous sheet having a mirror finished surface means for example a non-porous sheet having a surface with a surface roughness Ra of 0.03 to 0.1.

In contrast, when a sliding member using the second fiber sheet is applied to the fixing device, the sliding member, which is produced by forming the first fiber sheet on the second fiber sheet by electrospray deposition, has the first fiber sheet and the second fiber sheet entangled and thus presents an anchoring effect which enhances their adhesion and hence strength. Therefore, which one of the nonporous sheet and the second fiber sheet is used as the base material sheet can be determined by considering which one of slidability and strength should be given priority depending on the application. In other words, when it is desired to give higher priority to slidability in the sliding member, it is preferable to use the non-porous sheet as the base material sheet, whereas when it is desired to give higher priority to strength in the sliding member, it is preferable to use the second fiber sheet as the base material sheet.

The second fiber sheet is preferably a nonwoven fabric, a woven material or a knitted material, and is for example aramid mesh, fluororesin mesh, aramid paper, aramid cloth, glass cloth, carbon cloth, fluororesin cloth, aramid felt, polyimide felt, fluorinated polyimide felt, polyamideimide felt, fluororesin felt, polyphenylene sulfide felt or the like. The second fiber sheet is also preferably a sheet identical in material to the first fiber sheet. The second fiber sheet composed of these fibers can also be combined with the first fiber sheet to ensure larger strength (or tensile strength). Among these fibers, in view of adhesion to the first fiber sheet, strength per thickness, availability and affinity with a lubricant as will be described below, a nonwoven fabric composed of ultrafine fibers of aramid mesh, fluororesin mesh, aramid paper, aramid cloth, aramid felt, polyimide felt, fluorinated polyimide felt, polyamideimide felt, fluororesin felt, polyphenylene sulfide felt, or these polymers is preferably used as the second fiber sheet. In particular, in view of strength and availability, it is most preferable to use a nonwoven fabric composed of ultrafine fibers of aramid paper, aramid mesh, polyimide or polyphenylene sulfide as the second fiber sheet.

However, forming the second fiber sheet of a material of a polymer different from the first polymer that is a material of the ultrafine fibers of the first fiber sheet (i.e., the second polymer) is preferable as doing so allows adjustability to provide strength (or tensile strength) which can endure shearing deformation, as desired. On the other hand, forming the second fiber sheet of a material of a polymer identical to the first polymer that is a material of the ultrafine fibers of the first fiber sheet also allows adjustability to provide strength (or tensile strength) which can endure shearing deformation, as desired. That is, it should be noted that the sliding member according to the present embodiment also includes a configuration in which a multilayer structure of two or more layers is formed of the first fiber sheet alone.

When the sliding member has a multilayer structure of two or more layers formed of one or more first fiber sheets and one or more base material sheets, it is preferable that the first fiber sheet be disposed as a topmost layer and a surface of the topmost layer serve as a sliding surface. That is, in the layer structure of the sliding member, the first fiber sheet is preferably disposed at least on a side directly contacting a counterpart member such as an endless belt described later. This can enhance strength (or tensile strength) which can endure shearing deformation, and in addition increase porosity and decrease true contact area (As), and thus allows the sliding member to exhibit excellent performance.

Whether the sliding member may have a multilayer structure of two or more layers formed of one or more first fiber sheets and one or more base material sheets or a multilayer structure of two or more layers formed of the first fiber sheet alone, having a thickness of 10 to 200 μm in total is preferable in view of having both strength capable of enduring shearing deformation and excellent slidability. Furthermore, when the sliding member having a relatively small thickness of 10 to 200 μm is applied to a fixing device, it varies in thickness in a small amount, which can suppress paper wrinkles, poor separation and paper jamming easily occurring when thickness varies in a large amount, and can also suppress image noise such as luster, uneven fixing and the like.

<Lubricant>

In the sliding member according to the present embodiment, the first fiber sheet is preferably impregnated with a lubricant. The lubricant can be selected in type, as appropriate, from known lubricants depending on how the sliding member is used and the first fiber sheet's material(s). For example, silicone oil; a modified silicone oil having a substituent such as an amino group, an epoxy group, a glycidyl group, a carboxyl group, an acryloyl group or a methacryloyl group; fluorine oil; silicone grease: fluorine grease; etc. can be used as the lubricant.

It should be noted, however, that when the lubricant is oil such as silicone oil, and it reaches high temperature, it is significantly decreased in viscosity, and it may scatter under high load and high speed conditions and the sliding member may run out of the lubricant. Furthermore, leakage of oil, gelation of oil by a crosslinking reaction of oil in the sliding member, etc., increase viscosity which in turn increases torque with respect to the sliding member, an may impair durability. In contrast, when the lubricant is grease such as silicone grease, it is high in viscosity, and accordingly, torque increases under high load and high speed conditions, which increases a load on the sliding member and thereby may impair durability. Therefore, the lubricant is preferably in the form of a gel.

When the sliding member has a multilayer structure of two or more layers formed of one or more first fiber sheets and one or more base material sheets, the first fiber sheet may alone be impregnated with the lubricant or the first fiber sheet and the base material sheet may both be impregnated therewith.

<Siloxane Having Reactive Substituent>

The lubricant preferably includes siloxane having a reactive substituent (hereinafter also referred to as "reactive siloxane"). The reactive siloxane is preferably fixed to the first fiber sheet by the reactive substituent. As a result, when the first fiber sheet is impregnated with the lubricant, the lubricant can provide the sliding member with excellent slidability and durability together therewith. The lubricant including the reactive siloxane is in the form of a gel. Furthermore, in view of slidability, it is also preferable that the reactive siloxane include both or one of a fluoro group and a fluoroalkyl group.

The reactive substituent that the reactive siloxane has is preferably a substituent which reacts with a functional group which the first fiber sheet has. For example, the reactive substituent is preferably one or more types selected from the group consisting of an amino group, an epoxy group, a glycidyl group, a carboxyl group, an acryloyl group or a methacryloyl group. Inter alia, siloxane which has an amino group is suitable as it is commercially available in various grades and thus easily available. Note that the amino group as referred to herein refers to a monovalent functional group that is ammonia, primary amine, or secondary amine, said ammonia, primary or secondary amine having hydrogen removed therefrom.

The reactive substituent (one or more types selected from the group consisting of an amino group, an epoxy group, a glycidyl group, a carboxyl group, an acryloyl group and a methacryloyl group) is disposed in siloxane at an intramolecular position which can be indicated in three forms from chemical constitution formulae (13) to (15) shown below. In the chemical constitution formulae (13) to (15) shown below, "A" represents the reactive substituent. More specifically, there are a form in which the reactive substituent is disposed at opposite terminals of siloxane, as shown in the chemical constitution formula (13), a form in which the reactive substituent is disposed at one terminal of siloxane, as shown in the chemical constitution formula (14), and a form in which one such reactive substituent substitutes a constituent element of siloxane, or an alkyl group or hydrogen, as shown in the chemical constitution formula (15).

Note that, in the chemical constitution formulae (13) to (15) shown below, R represents an alkyl group which may have a substituent. This alkyl group is preferably a methyl group or an ethyl group. Furthermore, when a plurality of As are present in one molecule, identical or different substituents may be disposed at the locations of As, respectively.

(13)

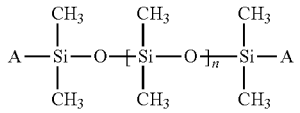

(14)

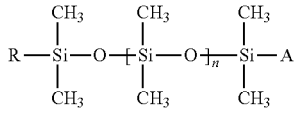

(15)

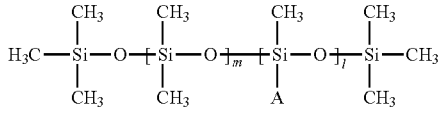

In the chemical constitution formulae (13) to (15) above, l, m, and n each represent a positive integer indicating a degree of polymerization. The positive integers indicating degrees of polymerization are as follows: l=1-500, m=0-300, m+1=10-500, and n=10-500. When a degree of polymerization is lower than the ranges of the values indicated by l, m, and n, siloxane will volatilize in a process for heating and firing the first fiber sheet impregnated with siloxane, and fixing the siloxane to the first fiber sheet, and not only is the siloxane unable to be held in the first fiber sheet in a desired amount, but there is also a possibility of contaminating the surroundings by the volatilized siloxane. When a degree of polymerization is higher than the ranges of the values indicated by l, m, and n, thermal oxidation causes degradation and thus easily decomposes the principal chain, and accordingly, there is a possibility of that siloxane leaks and/or scatters as it is decomposed, and furthermore, as the siloxane's decomposed matters react with each other, gelation is facilitated, and there is a possibility that torque may increase.

Furthermore, the reactive substituent is disposed in siloxane at an intramolecular position which can indicate another form other than the forms represented by the chemical constitution formulae (13) to (15). That other one form is a form in which two such reactive substituents substitute a constituent element of siloxane, or an alkyl group or hydrogen, although not described with reference to a chemical constitution formula.

In the present embodiment, it is advantageous in terms of slidability and durability that a reactive substituent is disposed at the opposite terminals of the siloxane. Siloxane having a larger number of methyl groups in one molecule is considered to impart higher slidability to the sliding member. This is because when disposing a reactive substituent at a terminal of siloxane is compared disposing a reactive substituent to substitute a constituent element of siloxane, or an alkyl group or hydrogen, the former allows a larger number of methyl groups in one molecule and hence high slidability. Furthermore, more substituents in one molecule allow larger strength after fixation to the first fiber sheet, and accordingly, disposing the reactive substituent at opposite terminals will allow more excellent durability than doing so at one terminal.

Note that the chemical structure of the siloxane that has the reactive substituent can be identified by using any one of the above describe FT-IR device, gas chromatography (GC), high performance liquid chromatography (HPLC) and an NMR device, for example.

In view of resistance to thermal oxidation, easiness of adding the siloxane to the first fiber sheet, and slidability, the siloxane suitably has a viscosity of 10-1000 $mm^2/s$ at 25° C. In particular, 10-100 $mm^2/s$ is preferable at 25° C. Siloxane having a viscosity of 10-100 $mm^2/s$ at 25° C. has a low molecular weight and is accordingly, characteristically less decomposable and less degradable. Furthermore, the equivalent of the functional group of the siloxane is suitably 100-10000 g/mol in view of strength, durability and slidability obtained after the siloxane is fixed to the first fiber sheet. The equivalent of the functional group of the siloxane is more preferably 500-5000 g/mol.

The siloxane's viscosity can be measured as follows: It can be measured with an Ubbelohde viscometer by ASTM D445-46T or JIS Z 8803. Furthermore, the equivalent of the functional group of the siloxane can be calculated as follows: The siloxane's weight average molecular weight is calculated by HPLC and the number of reactive substituents is obtained from the chemical structure of the siloxane identified as described above, and the number of these reactive substituents divided by the above weight average molecular weight serves as the equivalent of the functional group of the siloxane.

(Modifying the Sliding Member)

As a method for modifying the sliding member, a method will be described in which the first fiber sheet is impregnated with siloxane having a reactive substituent (a reactive siloxane) and the siloxane is fixed to the first fiber sheet by the reactive substituent (a siloxane modification method).

For example, in an example using the first fiber sheet composed of fluorinated polyimide and polyimide-based, ultrafine fibers (hereinafter also referred to as a "PI-based fiber sheet"), initially, the PI-based fiber sheet is immersed in a lubricant containing reactive siloxane or the lubricant is applied to the sheet and to impregnate the sheet with the lubricant. Subsequently, the siloxane-impregnated PI-based fiber sheet is heated and thus fired for about 6-24 hours in a temperature range of 150-200° C. using an oven capable of controlling moisture by dry blown air or the like. Thereby, a functional group of the first polymer composing the PI-based fiber sheet and a reactive substituent which the reactive siloxane has react with each other and thus chemically bond together. As a result, the PI-based fiber sheet is modified by siloxane (hereinafter also referred to as "siloxane-modified," "siloxane modification" etc.), and the siloxane is fixed to the PI-based fiber sheet.

In the above example it is preferable to impregnate the PI-based fiber sheet with the reactive siloxane-containing lubricant at a ratio of 5-25 parts by weight of the reactive siloxane-containing lubricant relative to 1 part by weight of the PI-based fiber sheet. Impregnating the PI-based fiber sheet with the lubricant in an excessive amount can promote sufficient siloxane modification in the PI-based fiber sheet. Furthermore, a fixing device having incorporated therein the sliding member impregnated with the lubricant in an excessive amount can in operation also cause siloxane modification in the PI-based fiber sheet and a polyimide surface layer used as a base material of the facing endless belt (or a counterpart member).

Furthermore, preferably, depending on the equivalent of the functional group of the siloxane to be heated and fired and the amount thereof to be added, the heating temperature and the heating time are adjusted as appropriate. When the heating temperature is too low or the heating time is too short, the PI-based fiber sheet is insufficiently siloxane-modified and the produced sliding member may have low durability. On the other hand, when the heating temperature is too high or the heating time is too long, the PI-based fiber sheet and the siloxane may be thermally oxidized and decomposed. Note that a standard heating temperature is in a range of 150-200° C., and a standard heating time is about 6-24 hours.

While in the above example has been described an example using a first fiber sheet composed of PI-based, ultrafine fibers, a first fiber sheet of ultrafine fibers of aramid or fluorinated aramid rather than PI-based ultrafine fibers can also be used to allow siloxane to be fixed to the first fiber sheet by a similar siloxane modification method.

Whether the first fiber sheet has been siloxane-modified and the siloxane has been fixed to the first fiber sheet, as desired, can be confirmed as follows: the aforementioned FT-IR device is used to determine a chemical bond of the first fiber sheet after the siloxane modification. Furthermore, the first fiber sheet having been siloxane-modified is immersed in deuterochloroform and in that condition it is measured with $^1$H-NMR device (trade name "JNM-ECZR," manufactured by JEOL Ltd.), and the portion "—NHCO—" which has additionally appeared and increased on the first fiber sheet through siloxane modification is qualified and quantified.

<Sliding Member for Fixing Device>

A sliding member for a fixing device according to the present embodiment is the above sliding member used for the fixing device. This fixing device includes a roller and an endless belt rotating together in contact with each other, and a pressing member which is disposed on the side of an inner circumferential surface of this endless belt. The pressing member presses the inner circumferential surface of the endless belt toward the roller and thus cooperates with the roller to sandwich the endless belt. The above sliding member is disposed between the endless belt and the pressing member.

<Fixing Device>

A fixing device 10 according to the present embodiment, as shown in FIG. 1, includes a roller 11 and an endless belt 12 rotating together in contact with each other, a pressing member 13 which is disposed on the side of an inner circumferential surface of endless belt 12, and a sliding member 14, as described above, disposed between endless belt 12 and pressing member 13. More specifically, in fixing device 10, pressing member 13 is disposed on the side of the inner circumferential surface of endless belt 12 with sliding member 14 interposed therebetween. Pressing member 13 presses the inner circumferential surface of endless belt 12 toward roller 11 and thus cooperates with roller 11 to sandwich endless belt 12. On the side of an outer circumferential surface of endless belt 12, roller 11 is disposed. That is, in FIG. 1, fixing device 10, as seen on the pressing member 13 side, has pressing member 13, followed by sliding member 14, followed by endless belt 12, followed by roller 11 disposed therein. Endless belt 12 has the inner circumferential surface composed of one or more types of resin selected from the group consisting of a polyimide-based polymer, a polyamideimide-based polymer, and polyetheretherketone-based polymer. Roller 11 can be any known roller used for fixing device 10.

<Endless Belt>

Endless belt 12 has the inner circumferential surface composed of one or more types of resin selected from the group consisting of a polyimide-based polymer, a polyamideimide-based polymer, and a polyetheretherketone-based polymer, as has been discussed above. Preferably, the resin is the polyimide-based polymer. In the present specification, the "polyetheretherketone-based polymer" refers to a polymer with polyether ether ketone serving as a principal chain.

Specifically, endless belt 12 may have the inner circumferential surface composed of any one of polyimide resin, polyamideimide resin, and polyetheretherketone (PEEK) resin known. Preferably, the polyetheretherketone resin is aromatic polyetheretherketone resin. More specifically, preferably, endless belt 12 has the inner circumferential surface composed of thermosetting polyimide resin in view of heat resistance and strength, and thermosetting fluorinated polyimide resin in view of heat resistance and slidability.

When endless belt 12 has the inner circumferential surface composed of thermosetting polyimide resin or thermosetting fluorinated polyimide resin, endless belt 12 can have the inner circumferential surface produced as follows: Initially, a lubricant containing siloxane having a reactive substituent as described above or a solvent containing siloxane having a reactive substituent is added to polyimide varnish at a proportion of 0.5-5 parts by mass (e.g., 1 part by mass) relative to 100 parts by mass of the polyimide's solid content. The polyimide varnish is then applied to the inner circumferential surface of endless belt 12, and endless belt 12 is heated to set the thermosetting polyimide resin or thermosetting fluorinated polyimide resin. Endless belt 12 having an inner circumferential surface with siloxane-modified thermosetting polyimide resin or thermosetting fluorinated polyimide resin fixed thereto can thus be obtained.

<Pressing Member>

Figure 2:
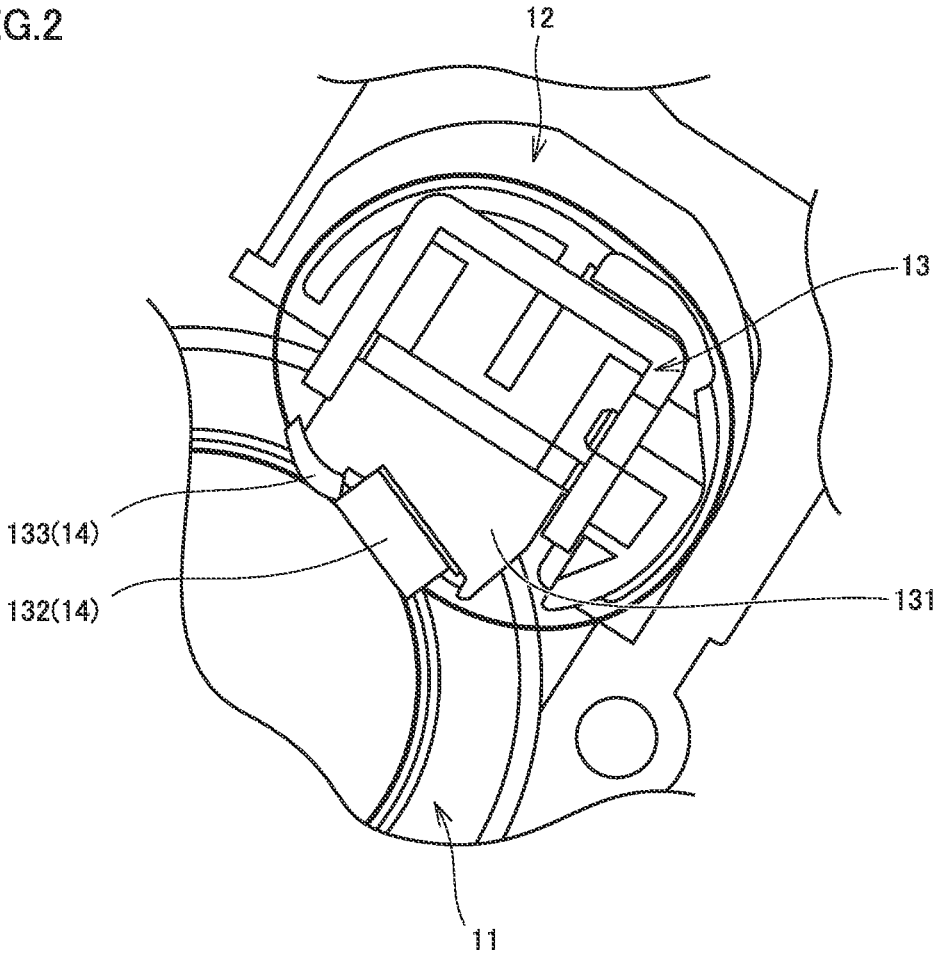
FIG. 2 is an enlarged schematic diagram showing a schematic configuration in a vicinity of an endless belt in the fixing device of the present embodiment.

Pressing member 13 has a support portion 131 serving as the pressing member's body, and a nip forming portion 132 and a high-pressure sliding portion 133, as shown in FIG. 2. When fixing device 10 is in the belt nip fixing system, pressing member 13 is required to have low thermal conductivity. Accordingly, support portion 131 is required to be of a material which has low thermal conductivity as well as heat resistance, large strength, and high dimensional stability. Specifically, suitably used as support portion 131 is thermoplastic resin composed of heat resistant resin such as liquid crystal polymer (LCP), polyimide and polyphenylene sulfide (PPS) with a filler such as glass fiber and carbon fiber blended therewith. Note, however, that as sliding member 14 of the present embodiment is formed of material having low thermal conductivity, a metal such as a sheet metal can also be used as pressing member 13 and support member 131.

Nip forming portion 132 is disposed on the side of the inner circumferential surface of endless belt 12 adjacent to roller 11, and presses endless belt 12 with sliding member 14 interposed and cooperates with roller 11 to have an effect to pressure-feed a recording sheet S which is a sheet of paper. Nip forming portion 132 is required to be of a material having large strength and low thermal conductivity to fix a transferred toner to recording sheet S, and, for example, silicone elastomer and heat-resistant nonwoven fabric are suitably used.

Furthermore, nip forming portion 132 can be implemented by sliding member 14 according to the present embodiment. In that case, sliding member 14 also has a function to serve as nip forming portion 132. That is, sliding member 14 can press endless belt 12 which in turn cooperates with roller 11 to pressure-feed recording sheet S. When sliding member 14 is applied as nip forming portion 132, the two functions of formation of a nip and high slidability can be provided to a single member, which is advantageous in terms of cost.

High-pressure sliding portion 133 is disposed on a side to which recording sheet S is pressure-fed from nip forming portion 132, and applies pressure to endless belt 12 with sliding member 14 interposed to have an effect to separate recording sheet S from roller 11. High-pressure sliding portion 133 is required to be of a material having high slidability, heat resistance, large strength, low thermal conductivity, and wear resistance.

High-pressure sliding portion 133 can also be implemented by sliding member 14 according to the present embodiment. In that case, sliding member 14 also has a function to serve as high-pressure sliding portion 133. That is, sliding member 14 can press endless belt 12 which in turn cooperates with roller 11 to pressure-feed recording sheet S.

Preferably, high-pressure sliding portion 133 also includes a curved surface having a curvature $\kappa$ ($mm^{-1}$) of 0.15 or more and 1 or less. Specifically, curvature $\kappa$ ($mm^{-1}$) is given to a surface of high-pressure sliding portion 133 which contacts endless belt 12. Such a curved surface allows high-pressure sliding portion 133 to apply higher contact pressure to recording sheet S than nip forming portion 132 does to thus separate recording sheet S from roller 11 and hence suppress paper jam. Furthermore, the curved surface having curvature $\kappa$ ($mm^{-}$) can reduce the contact area of the inner circumferential surface of endless belt 12 and high-pressure sliding portion 133, and hence reduce sliding resistance and hence torque. Curvature $\kappa$ ($mm^{-1}$) of a preferable curved surface which high-pressure sliding portion 133 includes is 0.165 or more and 0.7 or less.

<Heater>

Fixing device 10 according to the present embodiment includes a heater 15 which heats at least one of roller 11 and endless belt 12. As shown in FIG. 1, in the present embodiment, heater 15 is disposed inside roller 11. As heater 15, a halogen heater can be used in view of cost and durability. Note that heater 15 can be installed at any location allowing one or both of roller 11 and endless belt 12 to be heated. For example, where it is disposed can be determined in view of cost, warm up time reduction, rapid response, power consumption, etc. Heater 15 may be disposed at either one of roller 11 and endless belt 12 or may be disposed at both of them.

<Image Formation Apparatus>

Hereinafter, an image formation apparatus 100 of the present embodiment will be described based on FIG. 3.

Figure 3:
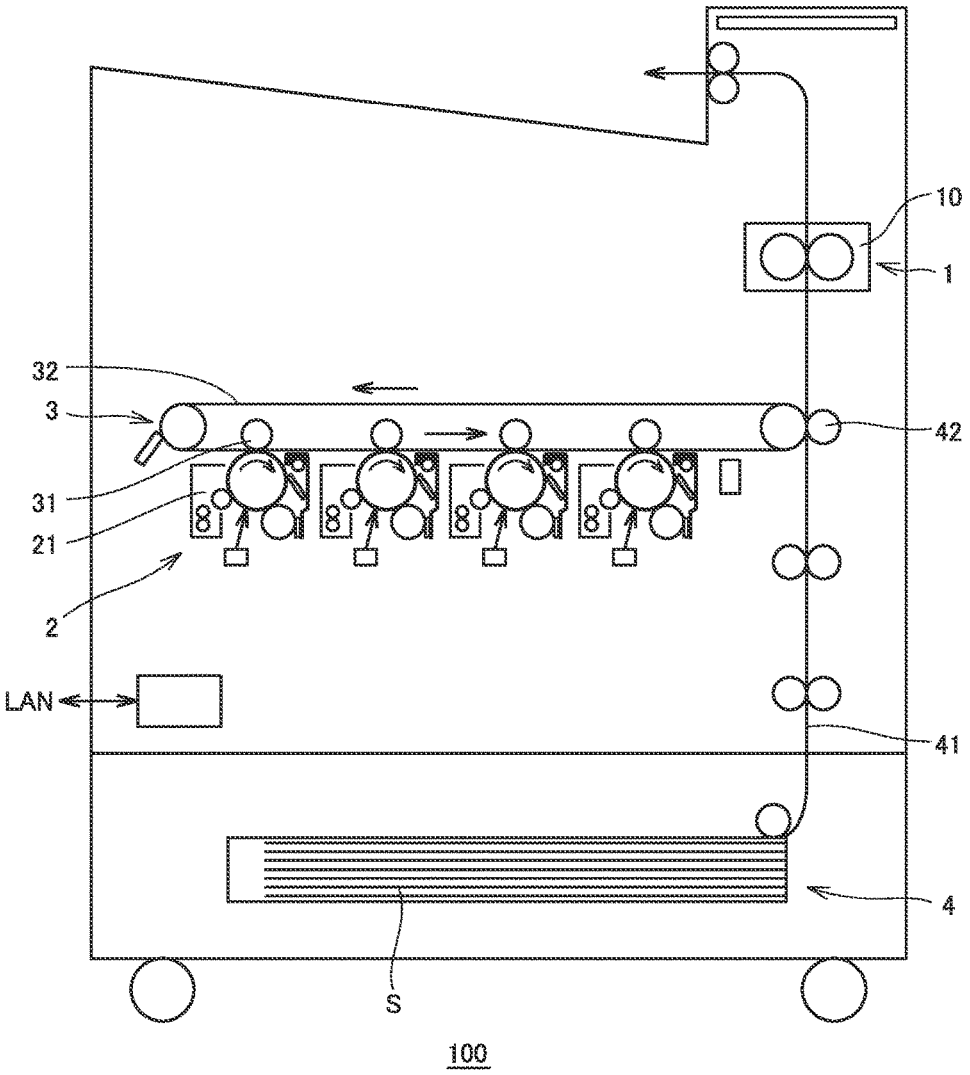
FIG. 3 is a schematic diagram showing a schematic configuration of an image formation apparatus of the present embodiment.

According to the present embodiment, image formation apparatus 100, as shown in FIG. 3, comprises a fixing unit 1, which will be described hereinafter, including fixing device 10 including sliding member 14 as described above. Image formation apparatus 100 is an apparatus which forms an image on recording sheet S by a known electrophotography system, and includes, as well as fixing unit 1, an image processing unit 2, a transfer unit 3, a sheet feeding unit 4, and a control unit (not shown). Image formation apparatus 100 receives a printing job from an external terminal device (not shown) via a network (e.g., a LAN), and selectively performs color or monochrome printing based on the printing job.

Image processing unit 2 has an image forming unit 21 corresponding to a developing color of each of yellow (Y), magenta (M), cyan (C), and black (K), and forms a toner image composed of each color based on the above printing job. Transfer unit 3 has a primary transfer roller 31 and an endless belt-shaped intermediate transfer body 32, and transfers the toner image that is formed by image forming unit 21 and composed of each color to intermediate transfer body 32 via primary transfer roller 31 through an electrostatic effect.

Sheet feeding unit 4 is timed, in response to image forming unit 21 forming a toner image, to feed recording sheets S, one by one, from a sheet feeding cassette to a transport path 41 to transport the sheet toward a secondary transfer roller 42. When recording sheet S transported passes between secondary transfer roller 42 and intermediate transfer body 32, the toner image formed on intermediate transfer body 32 is collectively, secondarily transferred onto recording sheet S through an electrostatic effect of secondary transfer roller 42.

Recording sheet S after the toner image is secondarily transferred thereon is transported to fixing unit 1. Furthermore, in fixing device 10 with which fixing unit 1 is equipped, the toner is fused and thus fixed on a surface of recording sheet S. Subsequently, the sheet is discharged by a sheet discharging roller onto a sheet discharging tray. Thus, an image corresponding to the toner image is formed on recording sheet S.

Note that while the above description corresponds to an operation in performing a color mode, when printing in black (i.e., a monochrome mode) is performed, the image forming unit for black color is alone driven and through each prescribed step an image in black is formed (or printed) on recording sheet S.

The control unit controls each component based on data of a printing job received from the external terminal device via the network to perform a smooth printing operation. Image formation apparatus 100 is provided with a console panel at a position on a front and upper side of the body of the apparatus which allows the user to easily operate the console panel. The console panel includes a button to receive a variety of instructions from the user, a liquid crystal display unit in the form of a touch panel, etc., and transmits a received instruction to the control unit.

As such an image formation apparatus, an image formation apparatus of an electrophotography system, such as a copier, a printer, a digital printer, and a simple printer, etc. can be mentioned for example. Although these image formation apparatuses may be of any of a dry system and a wet system, an image formation apparatus in the wet system is particularly effective. The image formation apparatus includes a fixing device having the sliding member according to the present embodiment, and can thus reduce image noise for a long period of time and hence form an image of high quality.

Furthermore, the image formation apparatus according to the present embodiment is not limited to a tandem-type color digital printer and may be a printer which forms a monochrome image. Furthermore, the image formation apparatus is applicable not only to a printer but also to a copier, an MFP (Multiple Function Peripheral), a fax, etc. (in any case, it may be any for a color image or a monochrome image).

EXAMPLES

Some sliding members according to the present embodiment underwent a performance evaluation and a result thereof will be described hereinafter. To evaluate the sliding members in performance, a color printer (trade name: "magicolor (registered trademark) 5440DL" produced by Konica Minolta Inc.) including a configuration identical to that of the fixing device described above was used. Specifically, sliding members of Examples 1-13 and Comparative Examples 1-4 were each disposed between the pressing member and the endless belt in the fixing device of the above color printer.

Here, in each of the sliding members of Examples 1 to 13 and Comparative Examples 1 to 4, an average fiber diameter of the ultrafine fibers composing the first fiber sheet was measured in the above-described method using a scanning electron microscope (SEM). Furthermore, the first fiber sheet's thickness was also measured in the above-described method using a micro gauge.

The endless belt in the fixing device has a cylindrical shape having φ 50 mm and a length of 280 mm and has the following configuration. That is, the endless belt, as seen in a cross section in the direction of its thickness, has a base material of Thermosetting polyimide resin of 60 μm in thickness, a 130 μm thick Si rubber layer disposed on the base material, and a 15 μm thick fluororesin layer disposed on the Si rubber layer. The endless belt is produced as follows: Initially, a base material composed of polyimide produced in advance by a casting method is inserted into a cylindrical mold with a clearance of about 130 μm, and subsequently, an Si rubber material is injected, vulcanized and cured to produce a polyimide base material-Si rubber belt. Furthermore, the polyimide base material-Si rubber belt can have the Si rubber's side coated with fluororesin to obtain the endless belt.

Hereinafter, the sliding members of Examples 1 to 13 and Comparative Examples 1 to 4 prepared will initially be described.

Example 1

(Producing a Sliding Member)

Initially, a spraying device (trade name: "csprayer ES-2100," manufactured by Fucnce co., Ltd.) was used to spray a precursor solution of perfluorinated polyimide (hereinafter also referred to as "FPI-1") to a second fiber sheet of aramid paper (Trade name: "NOMEX (registered trademark) T 411 5 mil," manufactured by DuPont Teijin Advanced Papers (Japan) Ltd., thickness: 130 μm) through electrospray deposition. Thus, a first fiber sheet (thickness: 20 μm) composed of ultrafine fibers composed of perfluorinated polyimide and having an average fiber diameter of 0.5 μm was formed on the aramid paper to thus produce the sliding member of Example 1 composed of two layers of the aramid paper and the first fiber sheet.

Used as the precursor solution of FPI-1 was a solution of N-methylpyrrolidone of perfluorinated polyamic acid composed of an aromatic diamine (4FMPD: tetrafluoro-1,3-phenylenediamine) represented by the following chemical formula (16) and an acid anhydride (10 FEDA: 1,4 bis (3,4-dicarboxytrifluorophenoxy) tetrafluorobenzene dianhydride) represented by the following chemical formula (17).

(16)

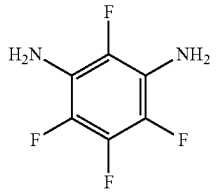

(17)

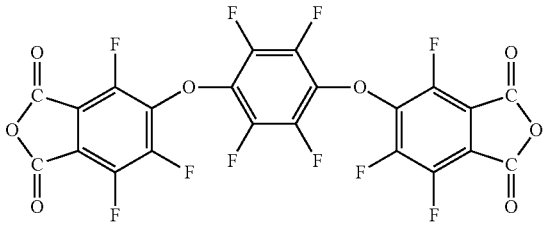

(Applying Sliding Member to Fixing Device)

Subsequently, the sliding member was disposed as a sliding sheet having a size of a length of 20 mm, a width of 250 mm, and a thickness of 150 μm in the fixing device between the pressing member at the nip forming portion and the endless belt, and fixed to the pressing member with a heat-resistant epoxy adhesive (trade name: "TSA-16," manufactured by Toray Industries, Inc.). This was done such that the sliding sheet had a topmost layer serving as the first fiber sheet. That is, the sliding sheet had the first fiber sheet on a side in direct contact with the endless belt. This sliding sheet was impregnated with 0.2 g of methacryl-modified siloxane serving as a lubricant of a reactive siloxane including a methacryloyl group as a reactive substituent (trade name: "X-22-164C" manufactured by Shin-Etsu Chemical Co., Ltd.) and heated and thus fired at 180° C. for 12 hours while being exposed to dry blown air having a dew point of −20° C. or lower to perform siloxane modification to thus subject the sliding member according to Example 1 to siloxane modification. In this siloxane modification, the methacryloyl group of the reactive siloxane and the amino group of the first fiber sheet react with each other.

Example 2

(Producing a Sliding Member)

The sliding member of Example 2 was produced by controlling the spraying device's electrolysis to change the average fiber diameter of the ultrafine fibers of the first fiber sheet to 1.5 μm, and had the remainder in configuration identical to the sliding member of Example 1.

(Applying Sliding Member to Fixing Device)

The sliding member (or sliding sheet) of Example 2 was fixed to the pressing member in the same manner as the sliding member (or sliding sheet) of Example 1. In Example 2, the sliding sheet was impregnated with a lubricant of a non-reactive silicone oil (trade name: "KF-96-300cs" produced by Shin-Etsu Chemical Co., Ltd.) and did not undergo siloxane modification. The sliding sheet in Example 2 was equal in size to that of Example 1.

Example 3

(Producing a Sliding Member)

Initially, the above spraying device was used to spray a precursor solution of FPI-1 to a stainless steel plate. Thus, a first fiber sheet (thickness: 100 μm) composed of ultrafine fibers composed of fluorinated polyimide and having an average fiber diameter of 4.8 μm was formed on the stainless steel plate to thus produce the sliding member of Example 3 composed of a single layer of the first fiber sheet.

(Applying Sliding Member to Fixing Device)

Subsequently, the sliding member was disposed as a sliding sheet having a size of a length of 20 mm, a width of 250 mm, and a thickness of 100 μm in the fixing device between the pressing member at the nip forming portion and the endless belt, and fixed to the pressing member with the above heat-resistant epoxy adhesive applied to the sliding sheet at a peripheral edge by a width of 2 to 3 mm. The sliding sheet was impregnated with 2 g of fluorine grease (trade name: "MOLYKOTE (registered trademark) G-8005," manufactured by Dow Corning Toray). Example 3 also did not have the sliding member subjected to siloxane modification.

Example 4

(Producing a Sliding Member)

Initially, the above spraying device was used to spray a precursor solution of partially fluorinated polyimide (also noted as FPI-2) to a stainless steel plate. This formed on the stainless steel plate a first fiber sheet (thickness: 20 μm) composed of ultrafine fibers composed of partially fluorinated polyimide and having an average fiber diameter of 2.1 μm. Subsequently, the above heat-resistant epoxy adhesive was applied to a non-porous sheet of polyimide film (trade name: "Kapton (registered trademark) 100H," manufactured by Du Pont-Toray Co., Ltd., thickness: 25 μm) at a peripheral edge by a width of 3-5 mm and the first fiber sheet was bonded thereon. Thus, a first fiber sheet composed of ultrafine fibers composed of partially fluorinated polyimide and having an average fiber diameter of 2.1 μm was formed on the polyimide film to thus produce the sliding member of Example 4 composed of two layers of the polyimide film and the first fiber sheet.

Used as the precursor solution of FPI-2 was a solution of N-methylpyrrolidone of partially fluorinated polyamic acid composed of an acid anhydride (6FDA: 2,2-bis (3,4-anhydrodicarboxyphenyl)-hexafluoropropane) represented by the following chemical formula (18) and an aromatic diamine (6FBAPP: 2,2-bis (p-(p-aminophenoxy) phenyl-1,1,1,3,3,3-hexafluoropropane) represented by the following chemical formula (19).

(18)

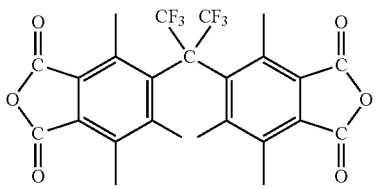

-continued (19)

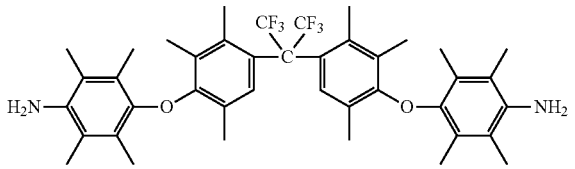

(Applying Sliding Member to Fixing Device)

The sliding member (or sliding sheet) of Example 4 was fixed to the pressing member in the same manner as the sliding member (or sliding sheet) of Example 1, and the sliding member underwent siloxane modification in the same method as Example 1 using the above methacryl-modified siloxane. The sliding sheet in Example 4 had a size of a length of 20 mm, a width of 250 mm, and a thickness of 45 μm.

Example 5

(Producing a Sliding Member)

Initially the above spraying device was used to spray a polyimide varnish (trade name: "U-Varnish (registered trademark)-ST-1001, solid content: 18%, solution viscosity: 5 Pa·s, solvent: N-methylpyrrolidone) to a stainless steel plate. Thus, a first fiber sheet (thickness: 50 μm) composed of ultrafine fibers composed of polyimide and having an average fiber diameter of 0.9 μm was formed on the stainless steel plate to thus produce the sliding member of Example 5 composed of a single layer of the first fiber sheet.

(Applying Sliding Member to Fixing Device)

Subsequently, the sliding member (or sliding sheet) of Example 5 was fixed to the pressing member in the same manner as the sliding member (or sliding sheet) of Example 1, and the sliding member or sheet underwent siloxane modification in the same method as Example 1 using the above methacryl-modified siloxane. The sliding sheet in Example 5 had a size of a length of 20 mm, a width of 250 mm, and a thickness of 50 μm.

Example 6

(Producing a Sliding Member)

Initially, the above spraying device was used to spray a precursor solution of FPI-1 to a second fiber sheet of an aramid mesh (trade name: "FiBRA MESH AKM-10/10," manufactured by Fibex Co., thickness: 48 μm). Thus, a first fiber sheet (thickness: 20 μm) composed of ultrafine fibers composed of perfluorinated polyimide and having an average fiber diameter of 1.5 μm was formed on the aramid mesh to thus produce the sliding member of Example 6 composed of two layers of the aramid mesh and the first fiber sheet.

(Applying Sliding Member to Fixing Device)

Subsequently, the sliding member (or sliding sheet) of Example 6 was fixed to the pressing member in the same manner as the sliding member (or sliding sheet) of Example 1, and the sliding sheet underwent siloxane modification in the same method as Example 1 using the above methacryl-modified siloxane. The sliding sheet in Example 6 had a size of a length of 20 mm, a width of 250 mm, and a thickness of 68 μm.

Example 7

(Producing a Sliding Member)

Initially, the above spraying device was used to spray the above precursor solution of FPI-1 to a stainless steel plate. This formed on the stainless steel plate a first fiber sheet (thickness: 20 μm) composed of ultrafine fibers composed of perfluorinated polyimide and having an average fiber diameter of 1.5 μm. Subsequently, the above heat-resistant epoxy adhesive was applied to a non-porous sheet formed of FPI-1 produced from the precursor solution of FPI-1 in a method described later (a fluorinated polyimide film) at a peripheral edge by a width of 3-5 mm and the first fiber sheet was bonded thereon. Thus, a first fiber sheet composed of ultrafine fibers composed of perfluorinated polyimide and having an average fiber diameter of 1.5 μm was formed on the non-porous sheet of FPI-1 to thus produce the sliding member of Example 7 composed of two layers of the non-porous sheet of FPI-1 and the first fiber sheet.

The non-porous sheet of FPI-1 (or fluorinated polyimide film) was produced by using the precursor solution of FPI-1 as described above, and depositing it by a casting method and drying the solution by an oven at 180° C. The non-porous sheet of FPI-1 had a thickness of 25 μm.

(Applying Sliding Member to Fixing Device)

Subsequently, the sliding member (or sliding sheet) of Example 7 was fixed to the pressing member in the same manner as the sliding member (or sliding sheet) of Example 1. In Example 7 the sliding sheet was not impregnated with a lubricant. The sliding sheet in Example 7 had a size of a length of 20 mm, a width of 250 mm, and a thickness of 45 μm.

Example 8

(Producing a Sliding Member)

The sliding member of Example 8 was produced such that the polyimide film composing the sliding member of Example 4 was changed to a non-porous sheet of FPI-2 produced from the above precursor solution of FPI-2 (or fluorinated polyimide film) in a method described hereinafter. The sliding member of Example 8 has a remainder identical in configuration to that of Example 4.

The non-porous sheet of FPI-2 (or fluorinated polyimide film) was produced by using the precursor solution of FPI-2 as described above, and depositing it by a casting method and drying the solution by an oven at 180° C. The non-porous sheet of FPI-2 had a thickness of 25 μm.

(Applying Sliding Member to Fixing Device)

Subsequently, the sliding member (or sliding sheet) of Example 8 was fixed to the pressing member in the same manner as the sliding member (or sliding sheet) of Example 1, and the sliding sheet underwent siloxane modification in the same method as Example 1 using the above methacryl-modified siloxane. The sliding sheet in Example 8 had a size of a length of 20 mm, a width of 250 mm, and a thickness of 45 μm.

Example 9

(Producing a Sliding Member)

In Example 9, the polyimide varnish used in Example 5 was not sprayed to a stainless steel plate and instead sprayed to the second fiber sheet of the above aramid paper (thickness: 130 μm). Thus, a first fiber sheet (thickness: 20 μm) composed of ultrafine fibers composed of polyimide and having an average fiber diameter of 0.9 μm was formed on the aramid paper to thus produce the sliding member of Example 9 composed of two layers of the aramid paper and the first fiber sheet.

(Applying Sliding Member to Fixing Device)

Subsequently, the sliding member (or sliding sheet) of Example 9 was fixed to the pressing member in the same manner as the sliding member (or sliding sheet) of Example 1. The sliding sheet underwent siloxane modification in the same method as Example 1 by using an amino-modified siloxane (trade name: "KF 8008," manufactured by Shin-Etsu Chemical Co., Ltd.) which is a lubricant of a reactive siloxane including an amino group as a reactive substituent. In this siloxane modification, the amino group of the reactive siloxane and a carbonyl group of the first fiber sheet react with each other. The sliding sheet in Example 9 had a size of a length of 20 mm, a width of 250 mm, and a thickness of 150 μm.

Example 10

(Producing a Sliding Member)

The sliding member of Example 10 is identical to that of Example 9.

(Applying Sliding Member to Fixing Device)

Subsequently, the sliding member (or sliding sheet) of Example 10 was fixed to the pressing member in the same manner as the sliding member (or sliding sheet) of Example 1. The sliding sheet underwent siloxane modification in the same method as Example 1 by using an epoxy-modified siloxane (trade name: "X-22-161C," manufactured by Shin-Etsu Chemical Co., Ltd.) which is a lubricant of a reactive siloxane including a glycidyl group as a reactive substituent. In this siloxane modification, the glycidyl group of the reactive siloxane and the amino group of the first fiber sheet react with each other. The sliding sheet in Example 10 was equal in size to that of Example 9.

Example 11

(Producing a Sliding Member)

Initially, a nanofiber mass-production apparatus (trade name: "Melt spinning apparatus MODEL: KNT type" manufactured by Kansai Electronics Co., Ltd.), was used to spray polyphenylene sulfide (PPS) (trade name: "FZ-2100," manufactured by DIC Corporation) at a melting temperature of 340° C. to obtain ultrafine fibers having an average fiber diameter of 5 μm. The ultrafine fibers of PPS were made into a sheet by needle punching and subsequently calendared to produce the sliding member of Example 11 which was composed of the first fiber sheet having an average weight of 20 g/m$^2$ per area and a thickness of 30 μm.

(Applying Sliding Member to Fixing Device)

Subsequently, three such sliding members were disposed one on another, disposed as a sliding sheet having a size of a length of 20 mm, a width of 250 mm, and a thickness of 90 μm in the fixing device between the pressing member at the nip forming portion and the endless belt, and fixed to the pressing member with a heat-resistant epoxy adhesive (trade name: "TSA-16," manufactured by Toray Industries, Inc.). This sliding sheet was impregnated with 2 g of methacryl-modified siloxane serving as a lubricant of a reactive siloxane including a methacryloyl group as a reactive substituent (trade name: "X-22-164C" manufactured by Shin-Etsu Chemical Co., Ltd.) and heated and thus fired at 180° C. for 12 hours while being exposed to dry blown air having a dew point of −20° C. or lower to perform siloxane modification to thus subject the sliding member (or sliding sheet) according to Example 11 to siloxane modification. In this siloxane modification, the methacryloyl group of the reactive siloxane and a sulfide group of the sliding member (or sliding sheet) react with each other.

Example 12

(Producing a Sliding Member)

Initially, fluorinated polyimide (FPI-3, trade name: "KPI-MX 300 F (75), Kawamura Sangyo Co., Ltd.) in a powdery form was dissolved in a solvent of a mixture of N-methyl pyrrolidone (manufactured by Wako Pure Chemical Industries, Ltd., purity: 97.0% by mass) and N, N-dimethylacetamide (manufactured by Wako Pure Chemical Industries, Ltd., purity: 97.0% by mass mixed together at a ratio of 8:2 to prepare an FPI-3 solution with FPI-3 having a concentration of 10% by mass. Furthermore, the above spraying device was used to spray the FPI-3 solution to a stainless steel plate to produce a first fiber sheet (thickness: 30 μm) composed of ultrafine fibers composed of FPI-3 and having an average fiber diameter of 1.5 μm. Furthermore, a method which is identical to that used to obtain the sliding member of Example 11 was used to also produce a second fiber sheet of ultrafine fibers of PPS (average fiber diameter: 1 μm, average weight per area: 20 g/m$^2$, thickness: 30 μm).

Subsequently, the above heat-resistant epoxy adhesive was applied to the second fiber sheet at a peripheral edge by a width of 3-5 mm and the first fiber sheet was bonded thereon. Thus, the sliding member of Example 12 composed of two layers of the second fiber sheet and the first fiber sheet was produced.

(Applying Sliding Member to Fixing Device)

The sliding member was made into a sliding sheet having a size having a length of 20 mm, a width of 250 mm and a thickness of 60 μm, and fixed to the pressing member in the same manner as the sliding member (or sliding sheet) of Example 1. This sliding sheet was impregnated with 1.5 g of methacryl-modified siloxane serving as a lubricant of a reactive siloxane including a methacryloyl group as a reactive substituent (trade name: "X-22-164C" manufactured by Shin-Etsu Chemical Co., Ltd.) and heated and thus fired at 180° C. for 12 hours while being exposed to dry blown air having a dew point of −20° C. or lower to perform siloxane modification to thus subject the sliding member according to Example 12 to siloxane modification. In this siloxane modification, the methacryloyl group of the reactive siloxane reacts with the amino group of the first fiber sheet and the sulfide group of the second fiber sheet.

Example 13

(Producing a Sliding Member)

Except for a melting temperature of 320° C., the same method as Example 11 was used to obtain ultrafine fibers having an average fiber diameter of 10 μm. The ultrafine fibers of PPS were made into a sheet by needle punching and subsequently calendared to produce the sliding member of Example 13 which was composed of the first fiber sheet having an average weight of 30 g/m$^2$ per area and a thickness of 50 μm.

(Applying Sliding Member to Fixing Device)

Except that two such sliding members as described above were disposed one on another, the same method as Example 11 was used to subject the sliding member (or sliding sheet) according to Example 13 to siloxane modification.

Comparative Example 1

As the sliding member of Comparative Example 1 was used a sliding member with which a fixing device "magicolor (registered trademark) 5440DL" equips as a standard. That is, the sliding member of Comparative Example 1 is a so-called PTFE-based heat resistant sheet obtained by impregnating a glass cloth with a fluororesin and sintering it.

Comparative Example 2

The sliding member of Comparative Example 2 was a so-called PTFE-based heat resistant sheet, as described above, impregnated with a lubricant composed of a non-reactive silicone oil (trade name: "KF-96-300cs" produced by Shin-Etsu Chemical Co., Ltd.).

Comparative Example 3

The sliding member of Comparative Example 3 was produced such that the first fiber sheet was composed of ultrafine fibers having an average fiber diameter changed to 5.8 μm, and had the remainder in configuration identical to that of the sliding member of Example 3. As the sliding member of Comparative Example 3 had the first fiber sheet composed of ultrafine fibers having an average fiber diameter changed to 5.8 μm, it had a thickness of 200 μm.

Comparative Example 4

The sliding member of Comparative Example 4 was produced such that the first fiber sheet was composed of ultrafine fibers having an average fiber diameter changed to 0.3 μm, and had the remainder in configuration identical to that of the sliding member of Example 1. As well as the sliding member of Example 1, the sliding member of Comparative Example 4 was fixed to the pressing member and underwent siloxane modification using the above methacryl-modified siloxane.

(Performance Evaluation)

Figure 4:
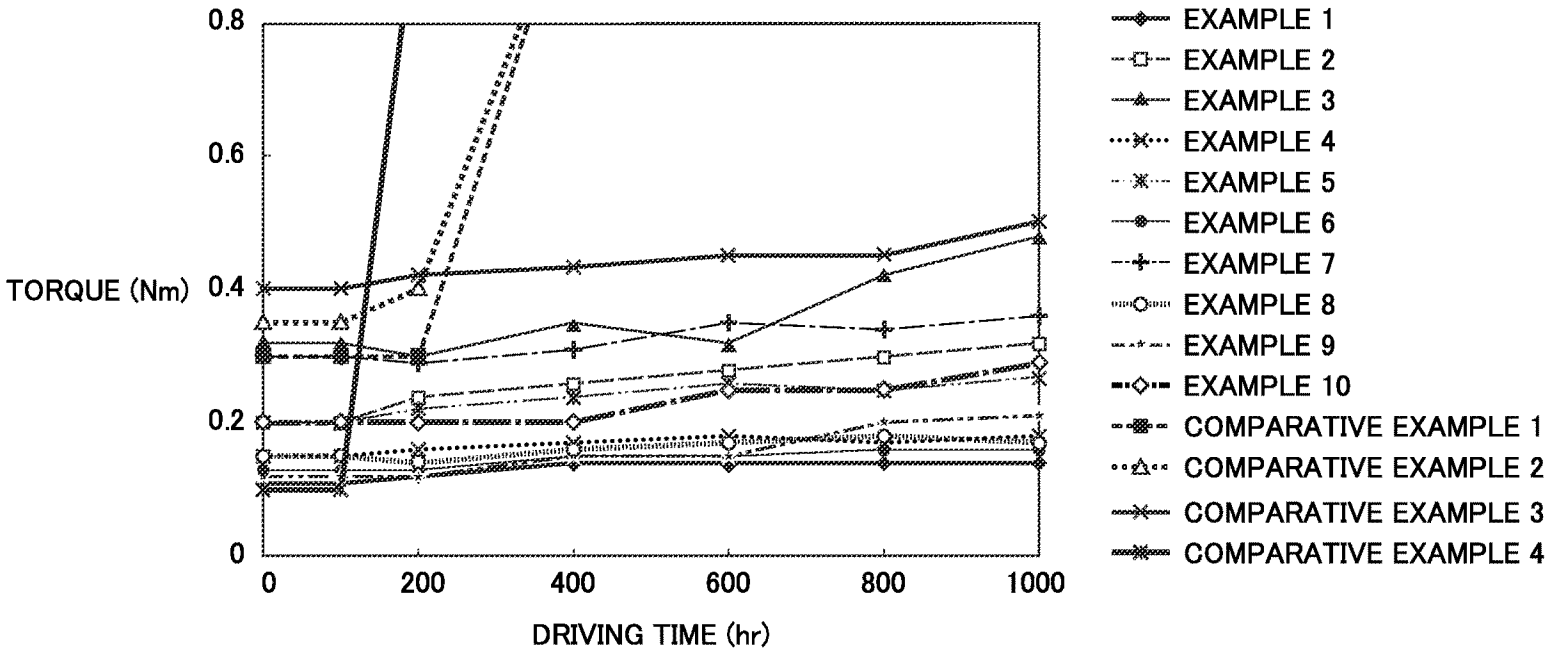
FIG. 4 is a graph which shows a relationship between a period of time of driving the fixing device and torque generated.
Figure 5:
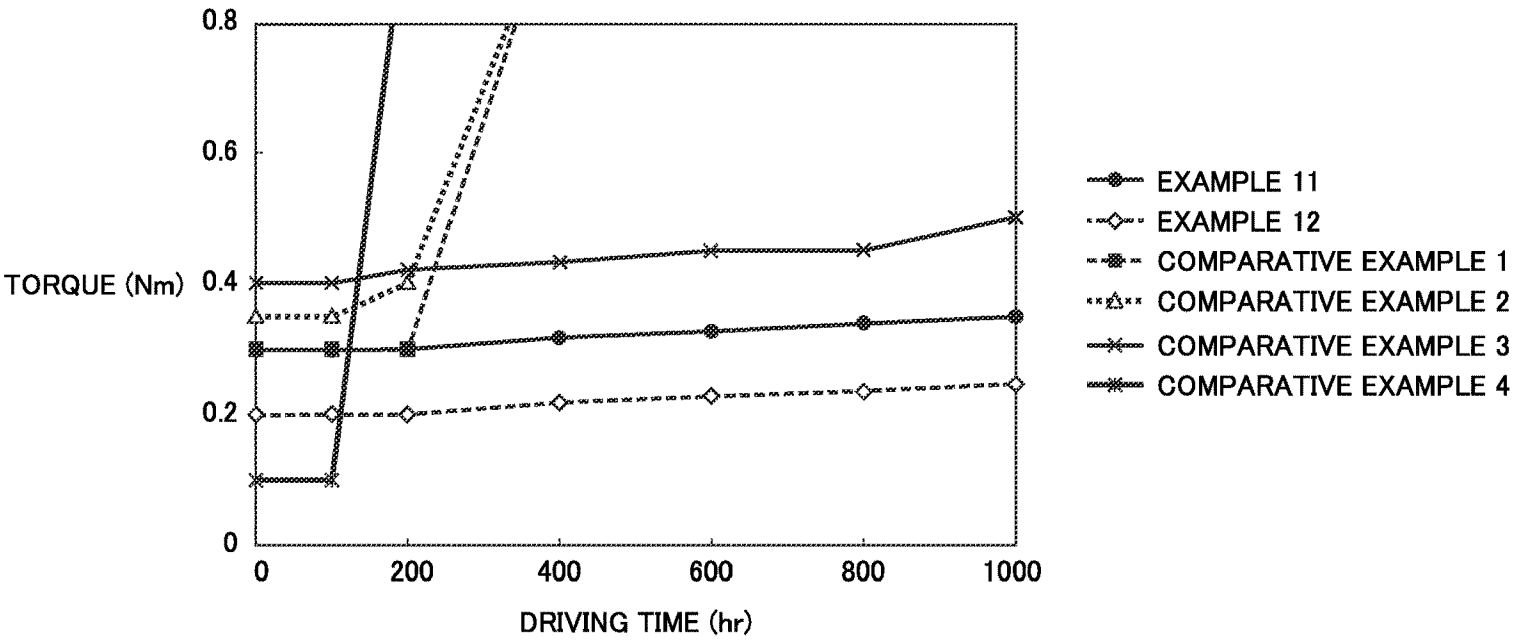
FIG. 5 is another graph which shows a relationship between a period of time of driving the fixing device and torque generated.

In a performance evaluation of each sliding members, the roller was set to a temperature of 200° C. and the fixing device was alone driven by an external motor at a speed of 250 mm/sec for 10 seconds and then stopped for 2 seconds, and thus intermittently operated for 1000 hours. Briefly, without performing a fixing operation for a recording sheet, the fixing device was intermittently driven for 1000 hours to evaluate how the sliding member sliding between the endless belt and the pressing member varies in performance. The performance evaluation was done such that a torque (N·m) of the external motor immediately after driving the device was started (i.e., in an initial stage) and a torque (N·m) of the external motor whenever a period of time of 100 hours elapsed while the device was driven were measured, and their variation was monitored. The torques were calculated as follows: a torque converter was disposed between a fixing device driving gear and the external motor and a jig equipped with an amplifier and an oscilloscope and dedicated to torque measurement was used to measure the torque converter's voltage. A result thereof is shown in tables 1 to 3. Furthermore, in FIGS. 4 and 5, graphs are presented to show torque varying as the driving time elapses in each of Examples 1-13 and Comparative Examples 1-4. Tables 1 to 3 indicate values of torque (N·m) measured immediately after the device was driven (i.e., in an initial state) and values of torque measured when a period of time of 1000 hours elapsed after driving the device had been started. Furthermore, in Tables 1 to 3, any event having occurred in the color printer after driving the device was started before a period of time of 1000 hours elapsed is described in the column "defects." In Example 7, in the performance evaluation, the above spraying device was used to spray the above precursor solution of FPI-1 to an inner circumferential surface of the endless belt (formed of thermosetting polyimide resin) to obtain a surface-treated endless belt.

The external motor's torque was measured under the following conditions:

Temperature: 200° C.

Driving speed: 250 mm/s

Set load: 250 N.

TABLE 1

| | 1st fiber sheet | | | | base material sheet | | | reactive siloxane | | evaluation result (200° C., 250 mm/s, 250N) torque (Nm) | | |
|---|---|---|---|---|---|---|---|---|---|---|---|---|
| | | average | | | | | | viscosity | | | 1K | |
| examples | material | fiber diameter | thickness | configuration | name (abbreviation) | classification | lubricant (trade name) | (25° C.) [mm²/s] | reactive substituent | initial | hour later | defects |
| 1 | FPI-1 | 0.5 μm | 20 μm | 2 layers | T411 5 mil | fiber sheet | X-22-164C | 90 | methacrylic group | 0.11 | 0.14 | No defects such as abnormal noise, belt meandering, breakage, etc. were confirmed. |
| 2 | FPI-1 | 1.5 μm | 20 μm | 2 layers | T411 5 mil | fiber sheet | KF96-300cs | — | — | 0.20 | 0.32 | |
| 3 | FPI-1 | 4.8 μm | 100 μm | single layer | — | — | G8005 | — | — | 0.32 | 0.48 | |
| 4 | FPI-2 | 2.1 μm | 20 μm | 2 layers | Kapton 100H | non-porous | X-22-164C | 90 | methacrylic group | 0.15 | 0.18 | |
| 5 | PI | 0.9 μm | 50 μm | single layer | — | — | X-22-164C | 90 | methacrylic group | 0.20 | 0.27 | |
| 6 | FPI-1 | 1.5 μm | 20 μm | 2 layers | AKM-10/10 | fiber sheet | X-22-164C | 90 | methacrylic group | 0.13 | 0.16 | |
| 7 | FPI-1 | 1.5 μm | 20 μm | 2 layers | FPI-1 sheet | non-porous | — | — | — | 0.30 | 0.36 | |
| 8 | FPI-2 | 2.1 μm | 20 μm | 2 layers | FP1-2 sheet | non-porous | X-22-164C | 90 | methacrylic group | 0.15 | 0.17 | |
| 9 | PI | 0.9 μm | 20 μm | 2 layers | T411 5 mil | fiber sheet | KF8008 | 450 | amino group | 0.12 | 0.21 | |
| 10 | PI | 0.9 μm | 20 μm | 2 layers | T411 5 mil | fiber sheet | X-22-163A | 30 | epoxy group | 0.20 | 0.29 | |

TABLE 2

| | ultrafine fiber sheet | | | | base material | | | reactive siloxane | | evaluation result (200° C., 250 mm/s, 250N) torque (Nm) | | |
|---|---|---|---|---|---|---|---|---|---|---|---|---|
| | | | | | sheet | | lubricant | viscosity | reactive | 1K | | |
| examples | material | average fiber diameter | thickness | configu-ration | name | classifi-cation | (trade name) | (25° C.) [mm²/s] | sub-stituent | initial | hour later | defects |
| 11 | PPS | 5 μm | 30 μm | 3 layers | ultrafine PPS fiber sheet | fibrous | X-22-164C | 90 | meth-acrylic group | 0.25 | 0.30 | No defects such as abnormal noise, belt meandering, breakage, etc. were confirmed. |
| 12 | FPI-3 | 1.5 μm | 30 μm | 2 layers | ultrafine PPS fiber sheet | fibrous | X-22-164C | 90 | meth-acrylic group | 0.20 | 0.25 | |
| 13 | PPS | 10 μm | 50 μm | 2 layers | ultrafine PPS fiber sheet | fibrous | X-22-164C | 90 | meth-acrylic group | 0.30 | 0.35 | |

TABLE 3

| | 1st fiber sheet (sliding member) | | | | base material sheet | | | reactive siloxane | | evaluation result (200° C., 250 mm/s, 250N torque (Nm) | | |
|---|---|---|---|---|---|---|---|---|---|---|---|---|
| compar-ative examples | material | average fiber diameter | thickness | configu-ration | name (abbrev-iation) | classifi-cation | lubricant (trade name) | viscosity (25° C.) [mm²/s] | reactive substituent | initial | 1K hour later | defects |
| 1 | PTFE-based | — | 130 μm | single layer | — | — | G8005 | — | — | 0.41 | — | Abnormal noise occured after 300 hours. Torque exceeded 1 Nm after 400 hours and belt meandered, and evaluation was stopped. |
| 2 | PTFE-based | — | 130 μm | single layer | — | — | KF98-300cs | — | — | 0.34 | — | Abnormal noise occured after 350 hours. Belt was broken after 410 hours and evaluation was stopped. |
| 3 | FPI-1 | 5.8 μm | 200 μm | single layer | — | — | G8005 | — | — | 0.40 | 0.5 | — |
| 4 | FPI-1 | 0.3 μm | 20 μm | 2 layers | T411 5 mil | fiber sheet | X-22-164C | 90 | methacrylic group | 0.10 | — | Sheet was broken after 100 hours and evaluation was stopped. |

As a result, it has been found that, as shown in Examples 1-13, with a sliding member that comprises a first fiber sheet composed of ultrafine fibers composed of a polyimide-based polymer or a polysulfide-based polymer, with the ultrafine fiber, when composed of the polyimide-based polymer, having an average fiber diameter of 0.5 μm or more and 5 μm or less, whereas, when composed of the polysulfide-based polymer, having an average fiber diameter of 1 μm or more and 15 μm or less, torque varied in a small range of 0.2 Nm or less between a time immediately after the device was driven (i.e., an initial state) and a time after a period of time of 1000 hours elapsed after driving the device had been started, and the sliding member can maintain stable performance even for use for a long period of time. Thus the sliding members of the Examples can be used for a long period of time and thus has a long life. In particular, in Examples 1, 4, 6, 8 to 10, and 12, torque was as small as 0.2 Nm or less immediately after the device was driven (i.e., in the initial state) and as small as 0.3 Nm or less after a period of time of 1000 hours elapsed after driving the device had been started, and it has been found that extremely excellent slidability is achieved. Thus, providing a sliding member in a 2-layer structure including the first fiber sheet and the base material sheet, impregnating a sliding member with a lubricant containing siloxane having a reactive substituent, and the like allow the sliding member to be used for a long period of time and also significantly excellent in slidability.

In contrast, in Comparative Examples 1 and 2, abnormal noise was caused in a prescribed period of time after driving the device had been started, and a defect had thus arisen before the device was driven for 1000 hours, and accordingly it was necessary to stop the evaluation. In Comparative Example 3, the ultrafine fibers composed of polyimide-based polymer had an average fiber diameter exceeding 5 μm and thus provided a small porosity and hence an increased As, and accordingly, torque measured immediately after the device was driven (i.e., in the initial state) was as high as 0.4 Nm and torque measured after the device was driven for 1000 hours was also as high as 0.5 Nm. In Comparative Example 4, the ultrafine fibers had an average fiber diameter less than 0.5 μm (more specifically, 0.3 μm) and hence small fiber strength, and the sliding member was broken when a period of time of 100 hours elapsed.

Although embodiments of the present invention have been described and illustrated in detail, it is clearly understood that the same is by way of illustration and example only and not limitation, the scope of the present invention should be interpreted by terms of the appended claims.

What is claimed is:

1. A sliding member which is used for a fixing device comprising an endless belt, the sliding member comprising a first fiber sheet composed of ultrafine fibers composed of a first polymer of a polysulfide-based polymer, a polyimide-based polymer, a polyamide-based polymer or a polyamideimide-based polymer, the ultrafine fibers, when composed of the polyimide-based polymer or the polyamideimide-based polymer, having an average fiber diameter of 0.5 μm or more and 5 μm or less, and the ultrafine fibers, when composed of the polysulfide-based polymer or the polyamide-based polymer, having an average fiber diameter of 1 μm or more and 15 μm or less, wherein the first fiber sheet consisting of a nonwoven fabric is in contact with the endless belt.

2. The sliding member according to claim 1, wherein the first polymer includes one or more types of functional groups selected from the group consisting of a sulfide group, an amino group, a carbonyl group, a fluoro group and a fluoroalkyl group.

3. The sliding member according to claim 1, wherein the sliding member has a multilayer structure of two or more layers formed of one or more first fiber sheets and one or more base material sheets, and the base material sheet is identical to or different from the first fiber sheet in material.

4. The sliding member according to claim 3, wherein the base material sheet is a non-porous sheet.

5. The sliding member according to claim 3, wherein the base material sheet is a second fiber sheet.

6. The sliding member according to claim 3, wherein the base material sheet is composed of a second polymer of one or more types selected from the group consisting of a polysulfide-based polymer, a polyimide-based polymer, a polyamide-based polymer and a polyamideimide-based polymer, and the second polymer includes one or more types of functional groups selected from the group consisting of a sulfide group, an amino group, a carbonyl group, a fluoro group and a fluoroalkyl group.

7. The sliding member according to claim 3, wherein the sliding member is such that at a topmost layer thereof the first fiber sheet is disposed and a surface of the topmost layer serves as a sliding surface.

8. The sliding member according to claim 1, wherein the first fiber sheet is impregnated with a lubricant.

9. The sliding member according to claim 8, wherein the lubricant is in a form of a gel.

10. The sliding member according to claim 8, wherein the lubricant includes siloxane having a reactive substituent, and the siloxane is fixed to the first fiber sheet by the reactive substituent.

11. The sliding member according to claim 10, wherein the reactive substituent is one or more types selected from the group consisting of an amino group, an epoxy group, a glycidyl group, a carboxyl group, an acryloyl group and a methacryloyl group.

12. The sliding member according to claim 1, wherein the fixing device comprises:

a roller and the endless belt rotating together in contact with each other, and a pressing member disposed on a side of an inner circumferential surface of the endless belt, the pressing member pressing the inner circumferential surface of the endless belt toward the roller and cooperating with the roller to sandwich the endless belt, the sliding member being disposed between the endless belt and the pressing member.

13. A fixing device comprising:

a roller and an endless belt rotating together in contact with each other;

a pressing member disposed on a side of an inner circumferential surface of the endless belt; and the sliding member according to claim 1 and disposed between the endless belt and the pressing member, wherein the first fiber sheet of the sliding member is in contact with the endless belt, the pressing member pressing the inner circumferential surface of the endless belt toward the roller and cooperating with the roller to sandwich the endless belt, the endless belt having the inner circumferential surface composed of one or more types of resin selected from the group consisting of a polyimide-based polymer, a polyamideimide-based polymer, and polyetheretherketone-based polymer.

14. The fixing device according to claim 13, wherein the resin is the polyimide-based polymer.

15. The fixing device according to claim 13, comprising a heater to heat at least one of the roller and the endless belt.

16. An image formation apparatus comprising the fixing device according to claim 13.

* * * * *